US006218940B1

(12) United States Patent
Rejc et al.

(10) Patent No.: US 6,218,940 B1
(45) Date of Patent: Apr. 17, 2001

(54) SAFETY DEVICE FOR MOTOR-OPERATED DOORS

(75) Inventors: Gabrijel Rejc, Landshut; Karl Eichstetter, Tiefenbach, both of (DE)

(73) Assignee: Efaflex Tor und Sicherheitssysteme GmbH & Co, (DE)

( * ) Notice: Subject to any disclaimer, the term of this patent is extended or adjusted under 35 U.S.C. 154(b) by 0 days.

(21) Appl. No.: 09/148,311

(22) Filed: Sep. 4, 1998

(30) Foreign Application Priority Data

Sep. 9, 1997 (DE) ..... 197 39 543

(51) Int. Cl.[7] ..... G08B 13/18

(52) U.S. Cl. ..... 340/556; 250/221

(58) Field of Search ..... 340/555, 556, 340/557, 545.3, 686.6; 250/221; 318/280, 466, 256, 264

(56) References Cited

U.S. PATENT DOCUMENTS

| | | | | |
|---|---|---|---|---|
| 4,166,369 | | 9/1979 | Nakajima . | |
| 4,750,592 | | 6/1988 | Watt . | |
| 4,794,248 | | 12/1988 | Gray . | |
| 4,818,866 | * | 4/1989 | Weber | 250/221 |
| 4,853,531 | | 8/1989 | Rejc . | |
| 4,953,608 | * | 9/1990 | Larsson | 160/1 |
| 5,233,185 | | 8/1993 | Whitaker . | |
| 5,286,967 | * | 2/1994 | Bates | 250/221 X |
| 5,601,134 | | 2/1997 | Pinkalla . | |
| 5,602,526 | | 2/1997 | Read . | |
| 5,894,267 | | 4/1999 | Blair . | |
| 5,969,637 | * | 10/1999 | Doppelt et al. | 340/825.69 |

FOREIGN PATENT DOCUMENTS

| | | | |
|---|---|---|---|
| 3603940 A1 | | 2/1986 | (DE) . |
| 86 03 304 | | 8/1986 | (DE) . |
| 3790010 | | 1/1987 | (DE) . |
| 3709592 A1 | | 3/1987 | (DE) . |
| 36 18 766 A1 | | 12/1987 | (DE) . |
| 4205251 A1 | | 2/1992 | (DE) . |
| 43 34 785 A1 | | 5/1994 | (DE) . |
| 4424537 A1 | | 7/1994 | (DE) . |
| 29707448 U1 | | 4/1997 | (DE) . |
| 19601660 A1 | | 7/1997 | (DE) . |
| 19604900 A1 | | 8/1997 | (DE) . |
| 0284066 | * | 9/1988 | (EP) . |
| 0 676 524 A1 | | 3/1994 | (EP) . |
| 0 789 182 | | 8/1997 | (EP) . |
| 2 685 496 | | 6/1993 | (FR) . |
| 09 189 183 | | 1/1996 | (JP) . |

OTHER PUBLICATIONS

Patent Abstract of Japan; Inventor: Masaji et al; Publication No. 09189183; Jul. 1997.

U.S. application No. 09/148,312 of Rejc filed Sep. 4, 1998.

* cited by examiner

*Primary Examiner*—Thomas Mullen

(74) *Attorney, Agent, or Firm*—Nixon & Vanderhye PC

(57) ABSTRACT

A safety device for preferably vertically moving, motor-driven doors such as, for example, segmented doors or rolling shutter doors whose door leaf is capable of being moved in a guided fashion is described. The movement path of a leading door edge is monitored by a preferably optical beam protection, preferably on the basis of infrared beams. The beam protection has at least two, preferably at least three or a plurality of preferably parallel beams which are arranged staggered in the direction of movement of the door and which are emitted on one side of the door and received or reflected on the other side of the door. Furthermore, a safety circuit is provided with which the closing movement of the door is stopped if an obstacle is sensed in the movement path of the door. The beam protection is arranged in such a way that the beam area defined by the beams has at least one line in common with the movement area through which the leading door edge passes, and that the autonomously operating safety device has a beam-state control device which assigns different activation states to the beams as a function of the position and of the movement of the door.

15 Claims, 6 Drawing Sheets

SAFETY DEVICE FOR MOTOR-OPERATED DOORS

BACKGROUND OF THE INVENTION

1. Field of the Invention

The present invention relates generally to a safety device for motor-operated doors such as, for example, segmented doors or rolling shutter doors. The safety device is used to sense an object located in the movement path of a door, rolling grille, lift away shutter door and the like.

1. Description of the Related Art

Such safety systems are known, for example, from the documents DE-U-8615042 or DE-A-3416546. According to DE-U-8615042, a safety strip, composed of a tube made of elastomeric material, of a termination profile is provided on one side with a lamp and on the other side with a light-sensitive resistance element. If the safety strip strikes an obstacle, the light beam is interrupted, causing a switching pulse which activates the engine brake to be generated.

DE-A-3416546 relates to a safety device for stopping motor-driven objects. In order to bring about improved response of the safety device for stopping motor-driven objects having a photoelectric barrier arrangement, the photoelectric barrier arrangement is composed of a light transmitter and a light receiver which are arranged at the two ends of a profiled rail having a light duct. When an obstacle is struck, the profiled rail composed of an elastically deformable material is squeezed together, causing the cross-section of the light duct to be reduced, so that the light beam is interrupted.

However, in these elastically deformable safety strips, adequate protection against injuries and damage is provided only if their deformation range corresponds to the follow-on travel of the leading edge of the terminating profile from the activation of the switching device up to the point where it is braked to a complete standstill. Owing to the weight, and in particular the kinetic energy, of the door leaf and of the terminating profile, there is, apart from the switching deceleration, a relatively long follow-on travel so that high, and thus expensive, safety strips have to be used.

A further disadvantage of such safety strips comprising profiled elastomeric material is, in addition to the unavoidable activation force and the resistance force resulting from its deformation, the fact that switching decelerations, or even switching failures, may occur depending on the direction of impact.

Owing to these problems, the procedure of arranging photoelectric barrier arrangements at a distance corresponding at least to the follow-on travel of the door leaf, in front of the leading edge of the terminating profile of the leaf door, so that the movement of the door leaf is stopped if an obstacle interrupts the light beam of the photoelectric barrier arrangement. Since the light beam runs at a distance in front of the terminating profile of the door leaf, it is ensured that the terminating profile does not come into contact with an obstacle which interrupts the light beam.

Examples of this are given in the documents EP-B-0325602 and EP-B-0284066. EP-B-0325602 discloses a safety device for rolling shutter doors in which the switching device is composed of a photoelectric barrier whose transmitter and pickup elements are arranged on each side of the terminating profile underneath said profile on supporting arms, at a distance corresponding to the braking distance. The supporting arms are guided in a sliding fashion in respective securing elements which are connected to a lower part of the door leaf. If the supporting arm strikes against the ground or a stop, the transmitter and pickup elements are displaced relative to the door leaf and toward it and arrive, at the end of the closing movement of the door, at a position which lies at least at the level of the lower terminating edge of the door leaf.

EP-B-0284066 discloses a high-speed door with a switching device which is provided in the region of the lower edge of the terminating profile and allows the brake to engage when said switching device is activated. The switching device is composed of a photoelectric barrier whose transmitter and sensor element are arranged on each side of the terminating profile at a distance below it corresponding to the braking distance, in the region of the lower ends of plungers which are guided so as to be capable of insertion in guides on the terminating profile or lateral blade-like projections. When the plungers strike the ground or a stop, the plungers dip into the guides so that the terminating profile can be supported on the ground.

In the two examples mentioned above, the transmitter and sensor element are arranged on part of the door leaf, with the result that the transmitter and sensor elements are moved with the door leaf. Owing to this movement, the electrical leads and other components of the electric circuit which extend between the door leaf and frame are subject to strong dynamic loads which are caused by vibrations in the door leaf and continuous bending stresses. In addition, dirt, dust and water may become deposited on various electrical system components and lead to a decrease in the performance or a malfunction of the system. In many cases, the fact that the electrical supply of the sensor and transmitter element has to be led through the door, so that the design of the door or of the door segments has to be adapted to this, proves problematic in these known systems. This adversely affects the flexibility of the user, but also of the manufacturer, as far as the door design is concerned.

Photoelectric area sensor systems are also known for protecting doors, said sensors being mounted either on one side of the door leaf or else, in order to improve the protection, on both sides of the door leaf. In the first case, adequate protection of persons and property is not provided on the side of the door leaf which is not equipped with the area sensor. In the latter case, the expenditure is too high and the photoelectric area sensor system is too expensive. In addition, it is a common feature of both systems that they are susceptible to incorrect switching if, for example, power supply components such as, for example, coiled cables, dip into the beam path of the photoelectric area sensor in an uncontrolled fashion due to external weather influences or the door leaf itself bulges out when subjected to the wind.

SUMMARY OF THE INVENTION

The object of the present invention is therefore to provide a safety device of the generic type which, with simple mounting facility, provides a maximum degree of system and personal safety for a door of any desired design and requires only low expenditure on control equipment.

According to the invention, a safety device which operates autonomously is provided, the beam-state control device of which operates in such a way that, once the position of the door (initialization phase) has been determined, a predetermined activation algorithm for the beam protection, for example in the form of individual photoelectric barrier systems, can run automatically. The algorithm according to the invention makes it possible to position the beams in the door movement path, with the result that a single photoelectric area sensor system is sufficient to monitor the entire movement path of the door, as a result of which the expenditure on technical equipment is further reduced. Because the actual position of the door determines the various activation states of the photoelectric barriers, the safety device is synchronized automatically with the movement of the door. It is no longer necessary to connect the control system of the door to be monitored, with the result that the safety device according to the invention can be retrofitted as, as it were, a "stand-alone solution" for any commercially available door or the like. In addition, the control circuit which is necessary is simple. The safety device according to the invention provides an unprecedented level of monitoring safety. This is because any object which is in contact with the monitored moving face of the door leaf inevitably causes the safety device to respond and immediately prevents activation of the drive unit for the door. Possible control errors, but also movement deviations owing to inertia (running-on of relatively large moving masses) are thus compensated from the outset.

Commercially available photoelectric barrier strips may be used in an embodiment of the invention.

Maximum safety is achieved with the development of because both lateral guides are thus also completely protected against unintentional intervention in it. Here, the additional advantage is obtained that the strip or strips of the photoelectric area sensor is covered by the means of guiding the door and are thus simultaneously protected against damage. A costly starting-up protection can thus be dispensed with.

Basically, to implement the solution principle according to the invention it is sufficient to implement a single pair of beams. The sensitivity of the safety device can be increased as desired and according to requirements if the beam protection is performed, according to an embodiment of the invention, by a photoelectric area sensor.

In a preferred embodiment, a device for determining the position of the closing edge of the door is provided and the beam-state control device is designed so that at least the beam which is nearest to the closing edge and is not covered by the door is assigned an inactive transition state (ZERO) between an active state (1) and a passive state (X). Further, a circuit is preferably provided which, as the door crosses during its closing movement the at least one beam which is in the transition state (ZERO), changes the next beam in the direction of closing movement from the active state (1) to the transition state (ZERO). This algorithm enables the beams through which the closing edge of the door successively passes to be placed sequentially and automatically into a passive state X, an inactive state 0 and an active state 1. These states are passed through sequentially with the movement of the leading edge.

Advantageously, the number of beams set to the transition state (ZERO) can be changed with the speed of movement of the door. This makes it possible, when required, to perform adaptation to the movement speed of the door in order to allow for the mass inertia of the door.

Feature that the beam which is interrupted by the closing edge and is in the transition state (ZERO) sets to the transition state (ZERO) the beam which is nearest in the direction of the closing movement of the door and is in the active state (1) leads to an advantageous signal flow in the system and to a continuous maximum safety state of the beams, even if the door is opened only slightly and then closed again.

If a buffering device is provided, the safety device may simultaneously be used as a detector device for determining the position and the direction of movement of the door.

In a preferred embodiment of the invention, the maximum area taken up by the safety device is reduced to reasonable dimensions of, for example, 2.5 m. The expenditure on examining the position, and thus on the safety device, is thus further reduced.

By providing a device wherein the distance of the beams from one another decreases in the direction of the closing movement of the door and/or the photoelectric area sensor is actuated at least in certain areas in such a way that a transmitter beam is evaluated by at least two receivers, enable the sensitivity of the safety device to be kept particularly high wherever specific hazard scenarios occur, such as for example at a low height above the ground, at which level flat extension arms of forklift trucks move. The cross-beam technology has here the particular advantage that relatively simple photoelectric protection strips with a relatively large pitch pattern and identical pitch of the transmitter/receiver can be used.

The safety device is not restricted to any orientation of the door movement or to specific door leaf designs.

If the strips of the protective photoelectric area sensor are arranged on the guides, the area covered by the photoelectric area sensor approximates so closely to the area of movement that sufficient safety is already provided for a large part of the instances of use.

A maximum degree of safety is obtained wherein the photoelectric strips of the beam protection are integrated into the guide profile, with the particular advantage of the easy retrofitability into existing guide systems.

Further features and advantages of the present invention are apparent from the description below of preferred embodiments of the present invention with reference to the appended drawing, in which:

DETAILED DESCRIPTION OF THE INVENTION

Figure 1:
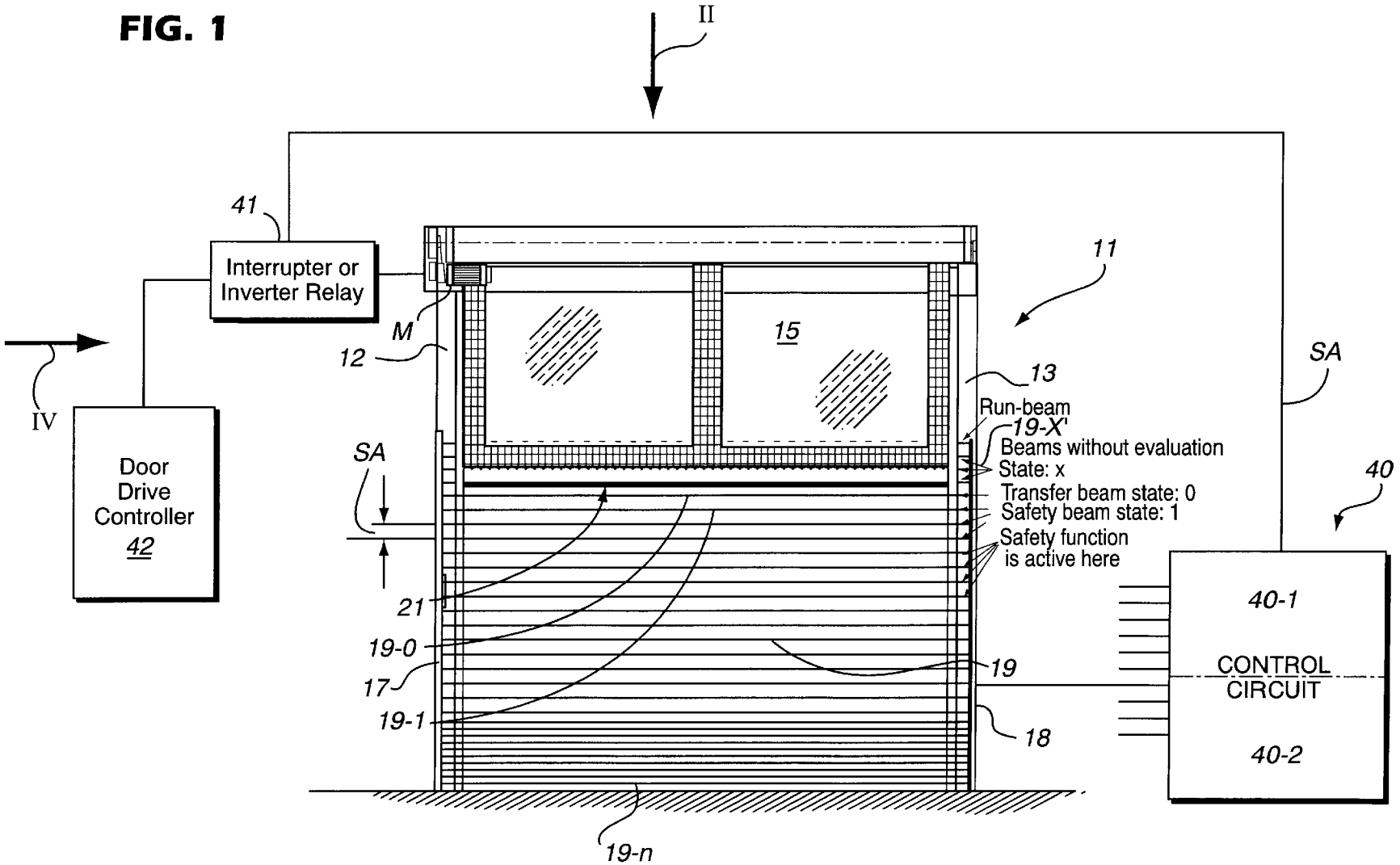
FIG. 1 shows a partially sectional front view of a rolling shutter door for which the safety device according to the invention is provided.
Figure 2:
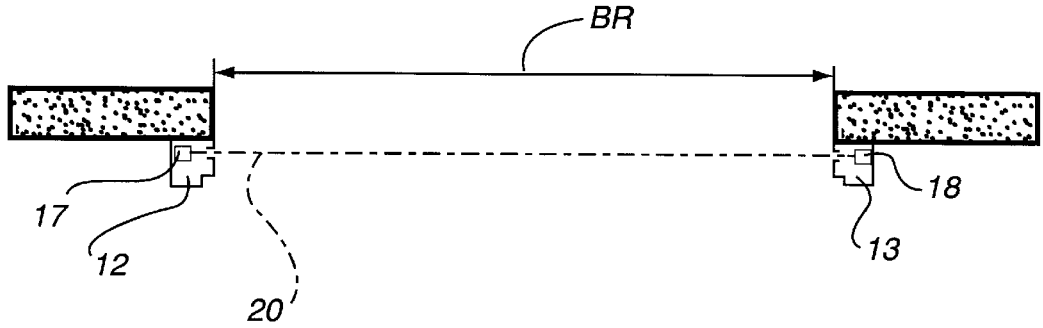
FIG. 2 shows the view according to "II" in FIG. 1.

In the description of the figures, those components which correspond to one another are provided with similar reference symbols, in front of which there is merely a different ordinal number.

A rolling shutter door 11 of the width BR and height HR is composed, in a known manner essentially of two laterally arranged hollow guide profiles 12 and 13 with U-shaped cross sections, a cross member 14 which rests on the lateral guide profiles and in which a motor and a winding shaft which is driven by the motor are accommodated, and a flexible door leaf 15 which is guided in vertically extending slit-like guides in the lateral guide profiles 12 and 13 and is wound onto the winding shaft.

Since the rolling shutter door for which the safety device according to the invention is used corresponds to a generally known rolling shutter door, a more precise description of the rest of its design will not be given here.

A safety device which is independent of the door controller, i.e. operates autonomously and is preferably optical, is assigned to the rolling shutter door 11. For this purpose, on each side of the door leaf 15 there is a strip 17, 18 of a photoelectric area sensor arrangement, for example on the basis on infrared beams, one strip accommodating the photoelectric transmitter and the other strip the photoelectric receiver so that a plurality of one-way photoelectric barriers with the beams 19-1 to 19-n are formed.

In the embodiment shown, each transmitter is assigned a receiver. In addition, the beams run parallel to one another. However, this is not absolutely necessary. A transmitter may be assigned a plurality of receivers. In addition, the beams 19 may also run obliquely.

Figure 3:
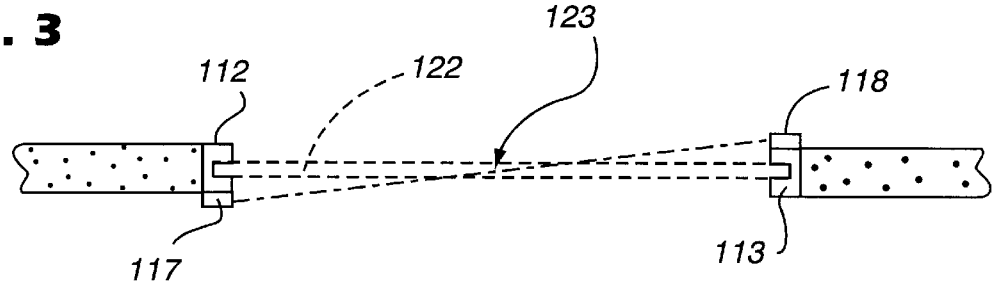
FIG. 3 shows a view, similar to that in FIG. 2, of a variant.
Figure 4:
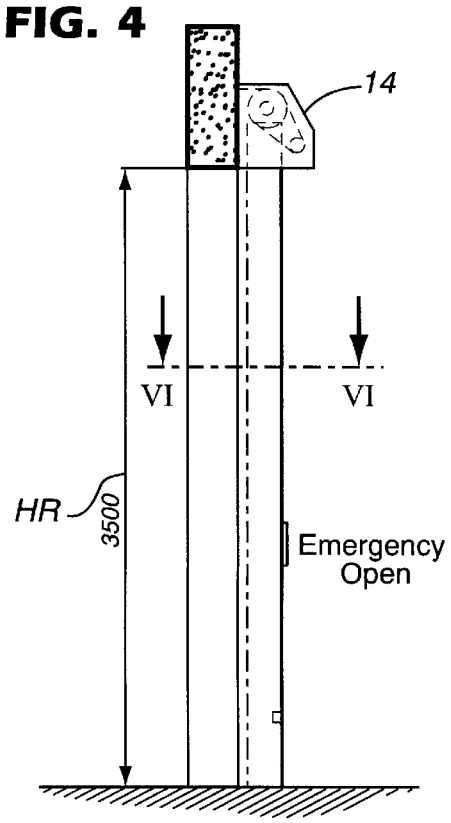
FIG. 4 shows a side view according to "IV" in FIG. 1.

The strips 17, 18 are attached in such a way that the area 20 covered by the light beams 19 has at least one line 123 (FIG. 3) in common with the area 122 of movement (FIG. 3) which the leading door edge 21 of the door leaf 15 passes through. In the embodiment according to FIGS. 1, 2, 4 and 5, the planes coincide, i.e. the photoelectric area sensor lies directly in the closing plane of the door leaf.

All the embodiments have in common that the strips 17, 18, and 117, 118 are attached to the guide rails 12, 13 and 112, 113. According to FIGS. 2, 4 and 5, they are arranged inside the guide rail and/or the guide profiles 12, 13; in the embodiment according to FIG. 3 they are attached to the side of the profiles 112, 113, specifically to different sides of the door leaf.

Figure 5:
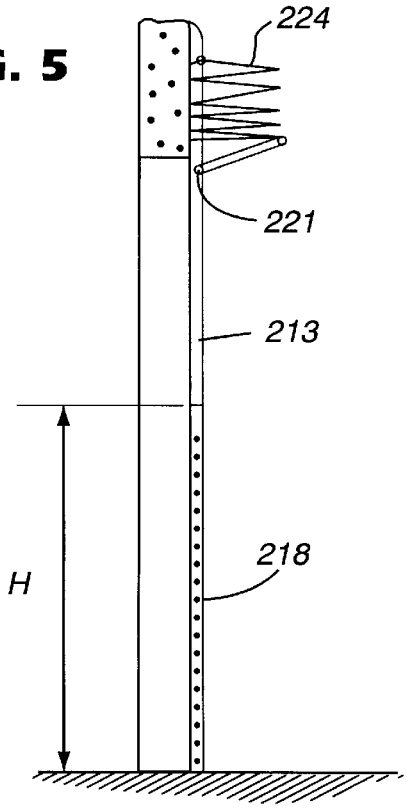
FIG. 5 shows a view, similar to FIG. 4, of a variant of the door.

The photoelectric barrier arrangement is used to monitor the closing movement of the door in order to exclude the possibility of the leading edge of the door striking an obstacle. FIG. 5 shows that the height H to be monitored may be appropriately limited to a reasonable dimension, for example to 2500 mm. The figure also shows that the door leaf may be of any desired shape, for example may be formed of folded segments 224. The leading edge 221 is in turn guided in a guide profile 213 in which the photoelectric strip 218 may also be accommodated.

Figure 6:
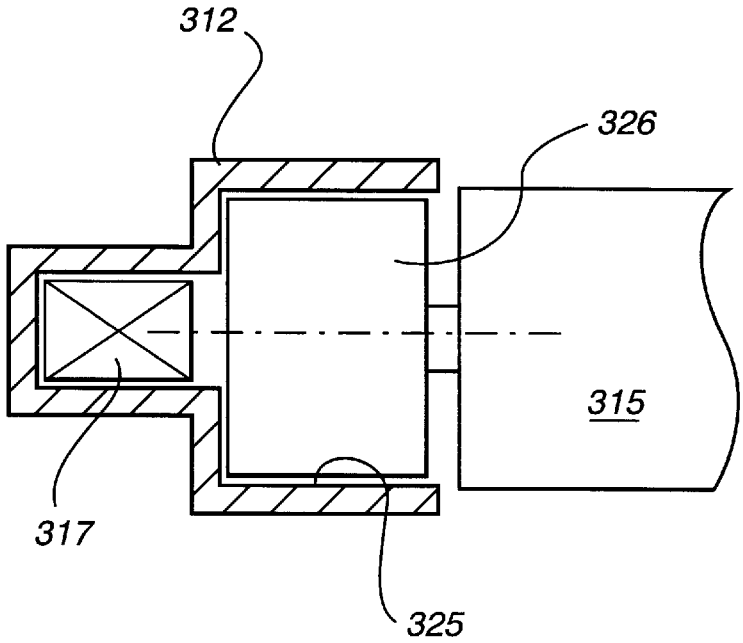
FIG. 6 shows section "VI—VI" in FIG. 4.
Figure 7:
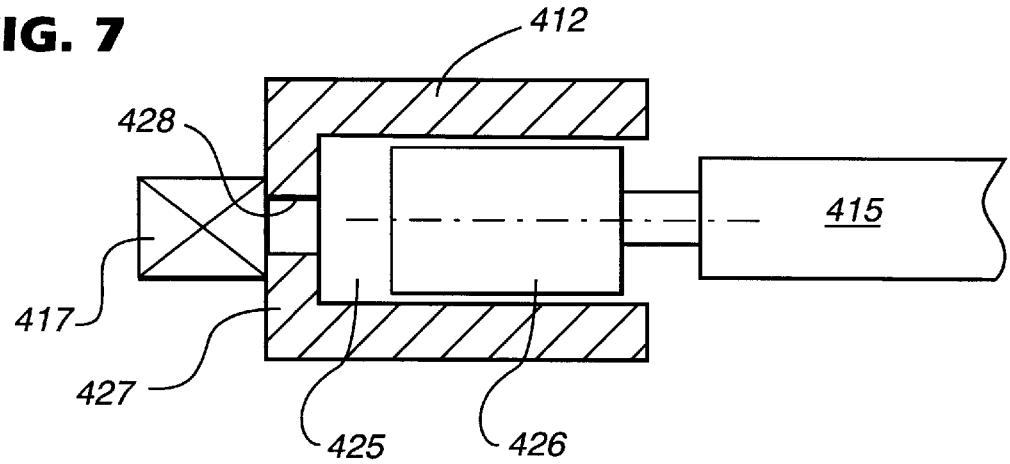
FIG. 7 shows a section, corresponding to FIG. 6, of a variant of the guide profile.

FIGS. 6 and 7 show variants of the arrangement of the photoelectric strips in or on the respective guide profile:

According to FIG. 6, the guide profile 312 is provided with a further profiled chamber which is adapted to the photoelectric strip 317 and adjoins the guide chamber 325 for a roller 326 of the door leaf 315. The gate is retrofitted here with the safety device according to the invention by exchanging the guide profile.

According to FIG. 7, the guide profile 412 can remain essentially unchanged when retrofitting is carried out. Here, the web 427 of the guide profile 412 contains a series of bore holes 428 in a pattern of holes corresponding to the photoelectric barrier arrangement. The photoelectric strips 417 are attached to the outside of the web 427.

So that the beams of the photoelectric barrier arrangement which lead from the transmitter to the receiver can run in the area of movement of the leading edge 21 of the door, the safety device has a specific control circuit with which the beams are sequentially assigned period activation states as a function of the position and the movement of the door leaf. This will be explained in more detail below:

In each case that beam 19-0 which is nearest to the leading edge 21 when the door closes receives transition state ZERO from the control circuit 40, i.e. if the edge 21 passes through this light beam shortly afterwards this photoelectric barrier does not emit a signal which interrupts the closing movement of the door leaf.

All the beams 19-x which lie behind the beam 19-0 in the direction of movement and have already been covered by the door leaf assume the inactive state X.

On the other hand, the beams 19-1 to 19-n are in the active state 1, i.e. each obstacle in the region of the beams 19-1 to 19-n ultimately supplies an output signal SA which is applied to an interrupter or inverter relay 41 in order to interrupt or reverse the drive of the motor. It is clear from the illustration according to FIG. 1 that the controller 42 of the door drive is thus detached from the safety device 40, i.e. that both devices 40, 42 operate independently of one another.

When the door leaf reaches the beam 19-0, the control circuit ensures that the beam 19-0 becomes the passive beam 19-x, while the beam 19-1 becomes the new beam 19-0. Thus, when the door leaf closes, all the beams change sequentially from the active state 1 into the transition state ZERO and finally into the passive state x, specifically controlled automatically by the movement of the door leaf. An exception to this is formed by the top beam which begins with the transition state ZERO.

The safety device serves simultaneously as a device for determining the position of the door leaf. For this purpose, preferably when the door is opened, the released beams are sequentially changed into the active state 1 via the transition state ZERO.

Figure 8:
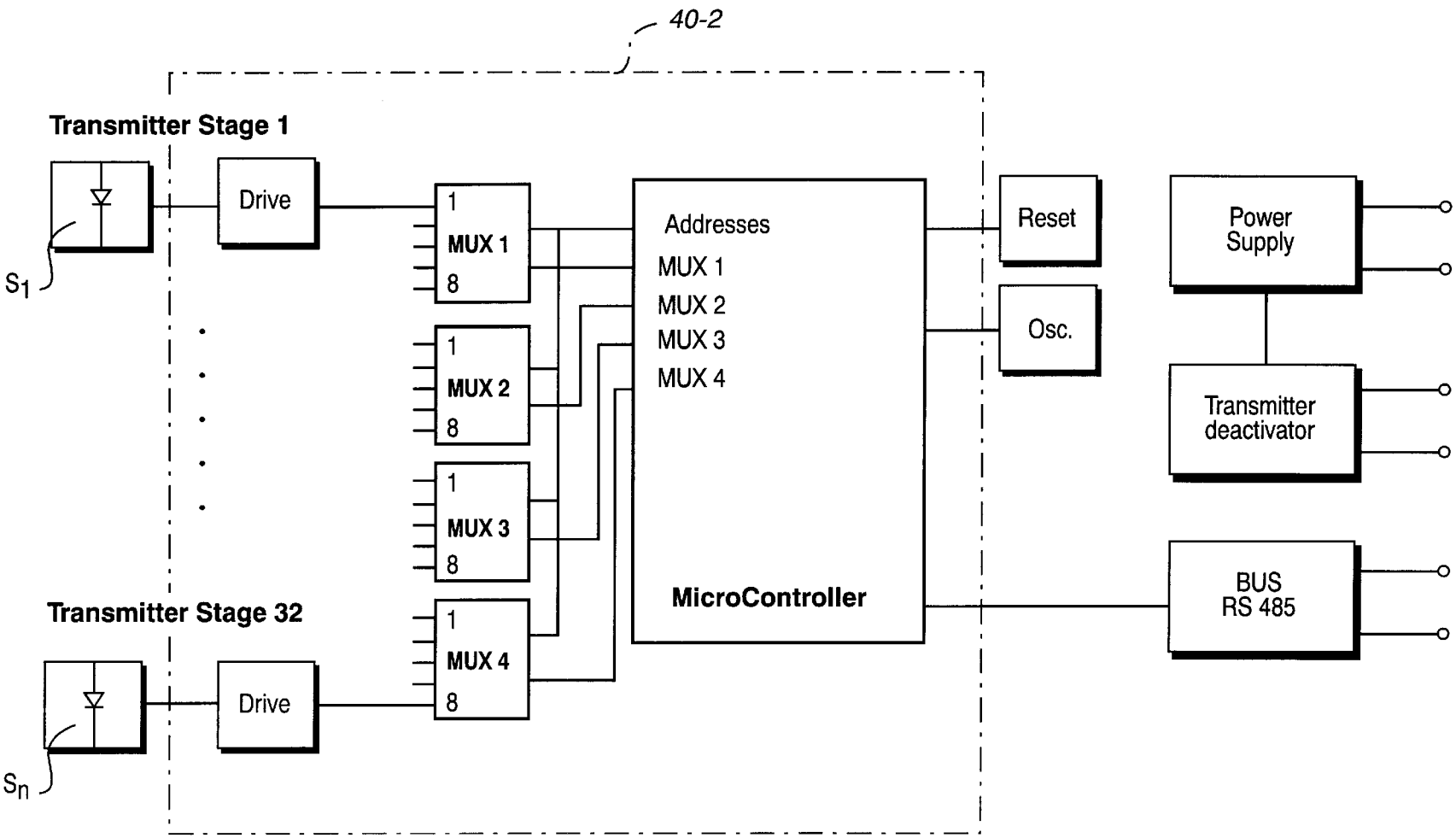
FIG. 8 and FIG. 9 show block circuit diagrams of the actuation and evaluation device of the safety device.
Figure 9:
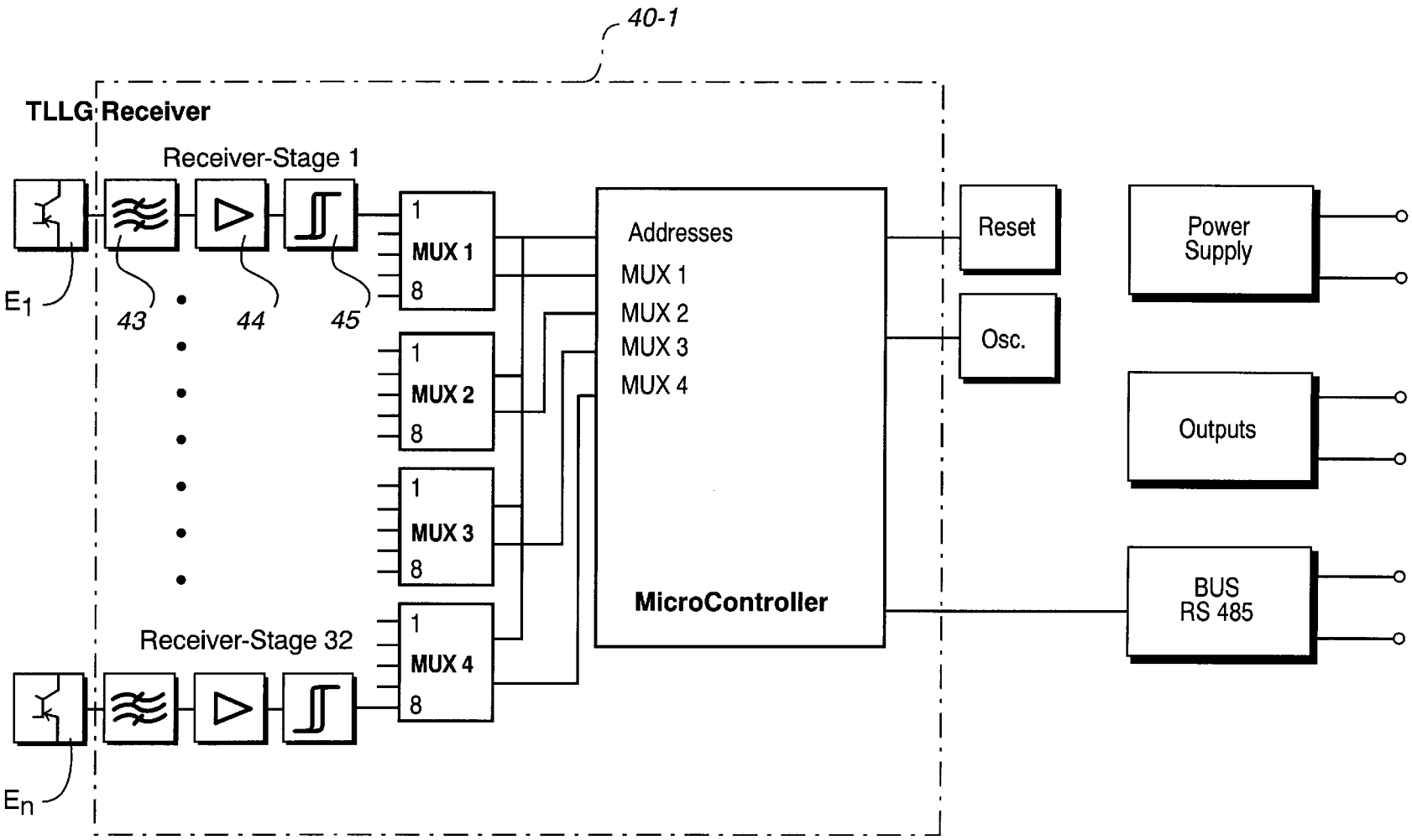

FIGS. 8 and 9 show a possible embodiment for the actuation of the photoelectric area sensor and the evaluation of the signals present at the individual photoelectric barriers. FIG. 8 shows the transmitter component 40-2, and FIG. 9 shows the associated receiver component 40-1.

The individual sensors S1 to Sn, for example in the form of light emitting diodes, and the receivers E1 to En in the form of phototransistors, i.e. the photoelectric barriers, can be addressed and evaluated individually by means of a multiplexer arrangement MUX1 to MUX4 which is known per se. That is to say the individual transmitters, such as for example light emitting diodes, can be switched on and off selectively and individually under the control of the microcontroller.

On the other hand, at the receiver end the signals which are received by the receiver, such as for example by the phototransistors, can be evaluated individually and selectively by means of the receiver-end microcontroller. For this purpose, filter circuits (43), amplifier circuits (44) and threshold value circuits 45 (Schmitt trigger) can be used to eliminate interference influences.

This arrangement can also be used to gate out selectively determined photoelectric barriers on an individual basis in order to represent, for example, a brief entrance via a threshold ramp or else the presence of a momentarily high coverage of snow.

Figure 10:
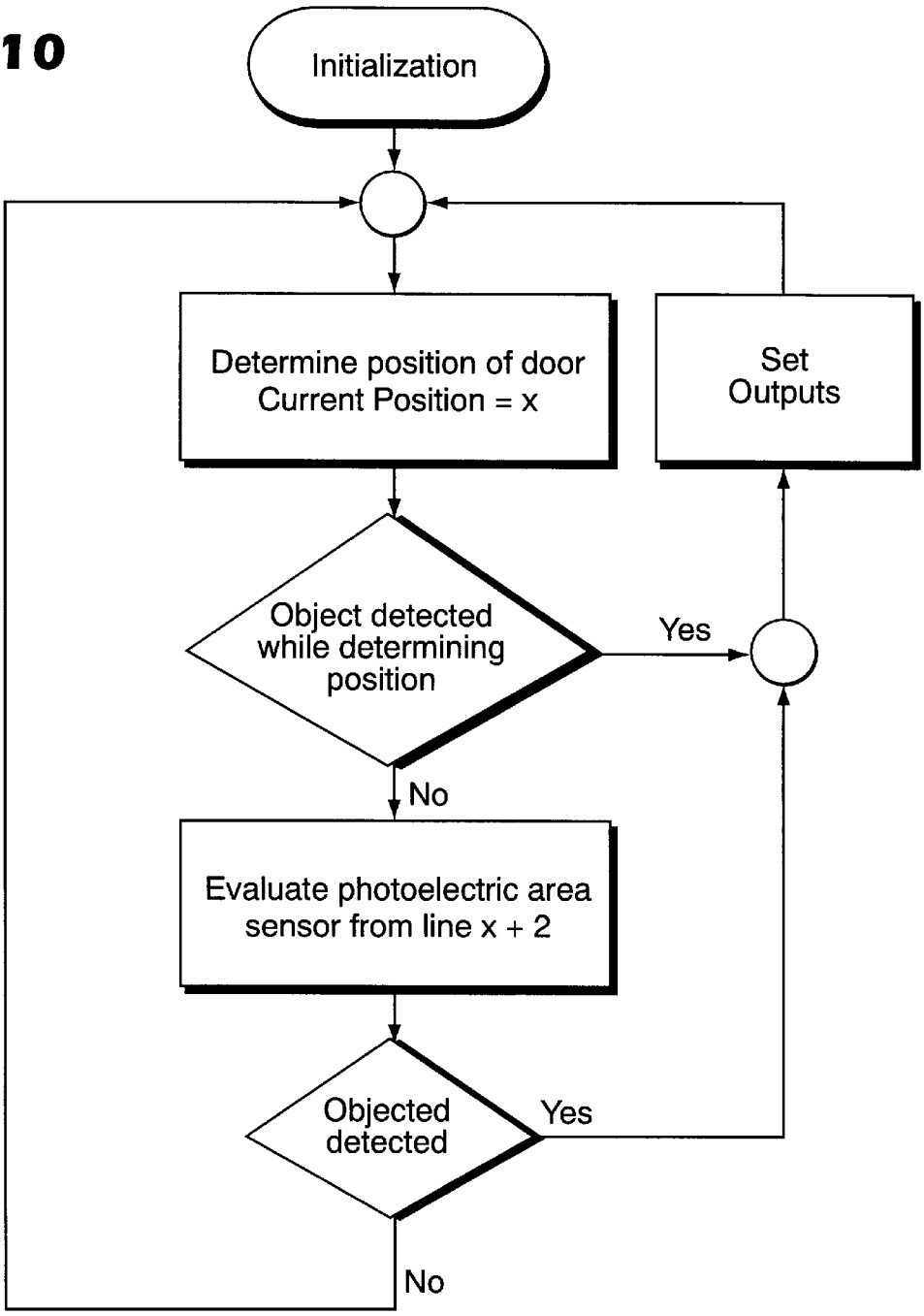
FIG. 10 shows a flowchart for explaining the mode of operation of the safety device.

Finally, the program sequence on which the safety device is based will be explained with reference to FIG. 10:

The system is initialized in step 1. The position of the leading edge of the door is determined, it being already possible at this point to access again the signals present at the individual addresses. The current position of the edge of the door will be assumed to be the x-th address, i.e. the x-th beam.

If an object is detected during the determination of the position, the control circuit emits an output signal SA, i.e. the outputs are set.

Otherwise, the photoelectric area sensor is evaluated starting from the position x+2, i.e. the address x+1 is given the state ZERO and all the beams x+2 to x+n are active.

If an obstacle is then sensed, the outputs are set. Otherwise, the routine starts again.

If the door is opened, the passive beams X are successively switched to "1", i.e. activated. Then, the same program steps as for closing occur, but inverted. If the door is then stopped, the last beam to be released is set to the "ZERO" activation state, i.e. it becomes the Run beam.

Of course, deviations from the previously described embodiments are possible without departing from the basic idea of the invention:

Thus, the beam protection is not necessarily restricted to light beams.

It is also possible for transmitters and receivers to be assigned to a single guide rail, so that a reflective photoelectric barrier is used. It is also possible to operate with a series of reflective light sensors.

In the illustrated exemplary embodiments, the light source may be, for example, a conventional light bulb, a light emitting diode or a laser. The light receiver unit can be a photoelectric receiver such as, for example, a photoelectric cell, a photoresistor, a photoelement or a photodiode.

Thus the invention provides a safety device for preferably vertically moving, motor-operated doors such as, for example, segmented doors or rolling shutter doors whose door leaf is capable of being moved in a guided fashion. The movement path of a leading door edge is monitored by a preferably optical beam protection, preferably on the basis of infrared beams. The beam protection has at least two, preferably at least three or a plurality of preferably parallel beams which are arranged staggered in the direction of movement of the door and which are emitted on one side of the door and are received or reflected on the other side of the door. Furthermore, a safety circuit is proved with which the closing movement of the door is stopped if an obstacle is sensed in the movement path of the door. The beam protection is arranged in such a way that the beam area which is defined by the beams has at least one line in common with the movement area through which the leading door edge passes, and that the safety device which operates autonomously has a beam-state control device which assigns various activation states to the beams as a function of the position and the movement of the door.

What is claimed is:

1. A safety device for externally-operated moving doors having a door leaf selectively moved in a guided fashion to close a door opening, said safety device including:

an optical beam protection assembly for monitoring a movement path of a leading edge of said door leaf, said optical beam protection assembly including a plurality of beam emitters for emitting a plurality of beams from one side of the door opening toward another side of the door opening in a direction generally transverse to said movement path; and a safety circuit for selectively at least one of stopping and reversing a closing movement of the door leaf upon sensing an obstacle in the movement path of the door leaf, wherein said beams of said protection assembly define a beam area that has at least one line, oriented in a door movement direction, in common with a movement area through which the leading door edge passes and wherein the safety device has a beam state control device that assigns one of a plurality of activation states to each of the beams as a function of the position and the movement of the door leaf.

2. The safety device as claimed in claim 1, wherein the beam area is a plane.

3. The safety device as claimed in claim 1, wherein the beam area coincides with the movement area.

4. The safety device as claimed in claim 1, wherein the beam protection assembly comprises a photoelectric area sensor.

5. The safety device as claimed in claim 1, wherein said beam state control device also determining the position of the leading edge of the door leaf, and wherein the beam-state control device assigns at least the beam which is nearest to the leading edge and is not covered by the door leaf an inactive transition state (ZERO) between an active state (1) and a passive state (X).

6. The safety device as claimed in claim 5, wherein the beam state control device includes a circuit which, as the door leaf crosses, during its closing movement, a said beam which is in the transition state (ZERO), changes a next beam in the direction of closing movement to the transition state (ZERO).

7. The safety device as claimed in claim 5, wherein the number of beams set to the transition state (ZERO) can be changed with the speed of movement of the door.

8. The safety device as claimed in claim 5, wherein a circuit is provided which, as the door leaf crosses, during its closing movement, a said beam which is in the transition state (ZERO), sets to the transition state (ZERO) a beam that is in the active state (1) and is nearest to the leading edge of the door leaf.

9. The safety device as claimed in claim 5, wherein the beams of said plurality of beam that assigned the passive state (X) are sequentially switched into the active state (1) during opening of the door leaf.

10. The safety device as claimed in claim 1 wherein a distance of the beams from one another decreases in the direction of the closing movement of the door leaf.

11. The safety device as claimed in claim 1, wherein the leading door edge of the door leaf moves vertically.

12. The safety device as claimed in claim 1 for monitoring a rolling shutter door or folding door in which at least the leading section of the door leaf is guided in lateral guide structures provided on each side of the door opening, and wherein the components of the optical beam protection assembly are arranged one of on and adjacent the guides.

13. The safety device as claimed in claim 12, wherein the beam protection assembly is a photoelectric area sensor including photoelectric strips, and wherein said photoelectric strips are integrated into the guide structures.

14. A safety device for moving externally operated doors having a door leaf selectively moved in a guided fashion to close a door opening, comprising:

an optical beam protection assembly for monitoring a movement path of a leading door edge of said door leaf and which generates a plurality of beams that are staggered along a direction of movement of the door leaf and are each emitted from a side of the door opening toward an opposite side of the door opening, and a safety circuit with which the closing movement of the door leaf is reversed or stopped upon sensing an obstacle in the movement path of the door leaf, wherein the beam protection assembly is disposed so that a beam area defined by the beams has at least one line oriented to intersect a movement area through which the leading door edge of the door leaf passes, and the safety device has a beam state control device for automatically reducing a door opening area monitored by the beams of the optical beam protection assembly as a function of the progressing obstruction of beams by the door leaf.

15. An apparatus for controlling the movement of a system component along a predetermined movement path, comprising:

a beam emitting assembly including a plurality of beam emitters that emit a plurality of beams from transmitters to receivers, wherein the beams are detected by the receivers for avoiding undesired collision of the moving system component with a foreign object, the plurality of beams being arranged to traverse a movement path of the system component to define a scanning field; and a safety circuit for selectively at least one of stopping and reversing a movement of the system component upon sensing a foreign object in the scanning field, and wherein the safety device has a beam state control device that assigns one of a plurality of activation states to each of the beams as a function of the position and the movement of the system component, said beam state control device being adapted to automatically assign a passive state (X) to those transmitters, receivers or pairs thereof that the system component has already passed, a transition state (ZERO) to the transmitter, receiver or pair thereof of which the corresponding beam will be crossed next during the movement of the system component, and an active state (1) to remaining transmitters, receivers or pairs thereof in a part of the movement path of the system component into or through which the system component has not yet passed.

* * * * *